US005078195A

United States Patent [19]

Schön

[11] Patent Number: 5,078,195

[45] Date of Patent: Jan. 7, 1992

[54] DOUBLE-WALLED PLEATED CURTAIN

[76] Inventor: Siegfried J. Schön, Kwadestraat 3, 4871 NH Etten-Leur, Netherlands

[21] Appl. No.: 462,482

[22] Filed: Jan. 9, 1990

[30] Foreign Application Priority Data

Jan. 10, 1989 [NL] Netherlands ..... 8900053

[51] Int. Cl.[5] ..... E06B 9/06

[52] U.S. Cl. ..... 160/84.1; 160/87

[58] Field of Search ..... 160/84.1, 330, 87, 115; 24/662

[56] References Cited

U.S. PATENT DOCUMENTS 3,229,342 1/1966 Cochran ..... 24/662 X
4,307,768 12/1981 Anderson ..... 160/84.1
4,677,012 6/1987 Anderson ..... 160/84.1

FOREIGN PATENT DOCUMENTS 0195483 9/1986 European Pat. Off. .
0222534 5/1987 European Pat. Off. .
2840023 3/1980 Fed. Rep. of Germany .

*Primary Examiner*—Blair M. Johnson
*Attorney, Agent, or Firm*—Wegner, Cantor, Mueller & Player

[57] ABSTRACT

A double-walled curtain of pleated material, wherein at least one fold of pleated material of the one wall is connected by means of two parallel connecting strips (10,11) to one or more folds of the other wall for the forming of a module, whereas the outward facing surfaces of the connecting strips bear co-acting coupling means, said modules being adapted to be extruded, whereby the height and width of the curtain can be determined in a simple manner, due to the tubular and endless length of material.

6 Claims, 1 Drawing Sheet

DOUBLE-WALLED PLEATED CURTAIN

The invention relates to a double-walled curtain of pleated material.

Such double-walled curtains have the advantage that the space between the pleats has an insulating effect against transfer of temperature and sound. The drawback to the known double-walled curtains is that these are relatively complicated to make and that in the case of damage repairs are difficult to carry out.

The invention has for its object to obviate the drawbacks mentioned above and provides to this end a double-walled curtain which is distinguished in that in each case at least one fold of pleated material of the one wall is connected by means of two parallel connecting strips to one or more folds of the other wall for the forming of a module, wherein the outward facing surfaces of the connecting strips display co-acting coupling means.

As a result of the use of the module construction for such curtains the manufacture thereof can be greatly simplified. The modules can in any case be obtained by extrusion. By just coupling the connecting strips to each other there results an assembled double-walled curtain which can not only be embodied in random designs but whereof the height and breadth can also be determined in a simple manner, since the starting point is a tubular and endless length of material.

The connection between the coupling strips is preferably such that it is releasable, whereby the repair of particular module portions can be easily carried out by removing them from the existing curtain and replacing them with one or more new modules.

The releasable connection can be effected by a slide connection or a snap coupling.

Above mentioned and other advantages and features of the invention will be elucidated in the figure description below of a number of embodiments.

Figure 1:
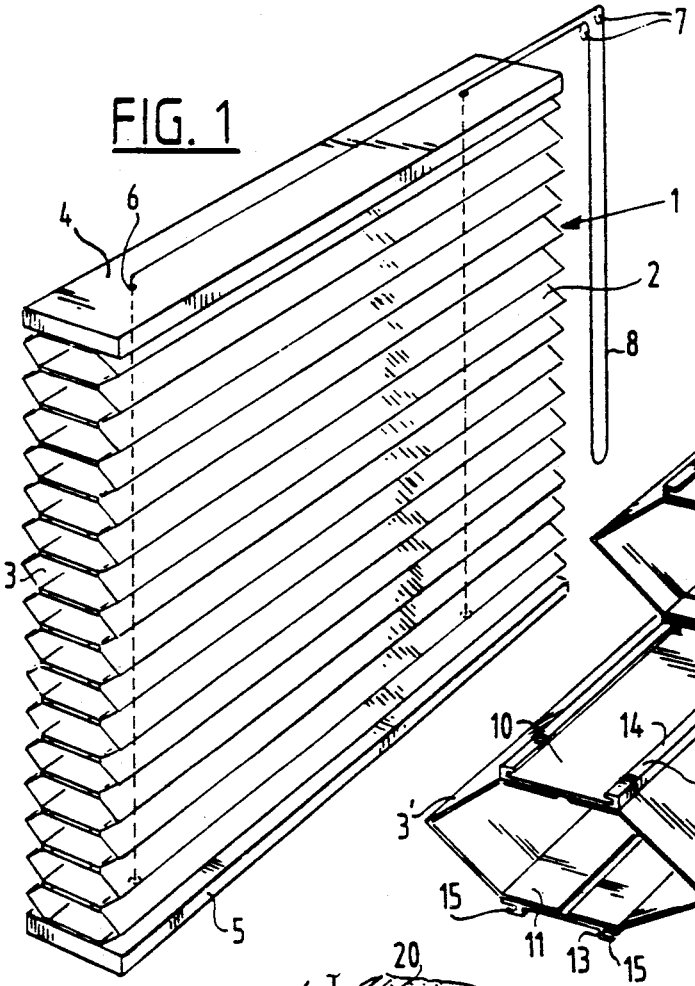
FIG. 1 shows a perspective view of a double-walled pleated curtain according to the invention.

Designated in the drawing with the numeral 1 is the double-walled folding curtain which consists of a pleated front side 2 and a pleated rear side 3. The curtain is suspended at the top on a normally fixed upper beam 4 and provided at the bottom with a beam 5 that is up and downwardly movable relative to the beam 4. In the case the beam 4 takes a fixed form it is attached by any suitable fastening means to the upper member of a framework for a window or the like, wherein the lower beam 5 is suspended from guide cords 6. These guide cords are fastened to the beam 5 and are carried through the space between the front and rear wall portions 2, 3 of the curtain 1 up to through-holes 6 in the upper beam 4. Therefrom they are guided away horizontally and via a guide roller 7 made accessible to the user in the form of a loop 8. By pulling down the loop 8 the beam 5 can be pulled up, whereby the pleated material of the front and rear walls 2, 3 of the curtain 1 will fold or stretch more or less in concertina fashion. If the curtain is used for screening off a window, the space between the front and rear wall of the curtain is then suitable for functioning as a barrier against sound and heat transfer.

According to the invention the front and rear wall 2, 3 are mutually coupled at regular intervals by connecting strips 10, 11, which will be further elucidated hereinafter with reference to FIG. 2–5.

Figure 2:
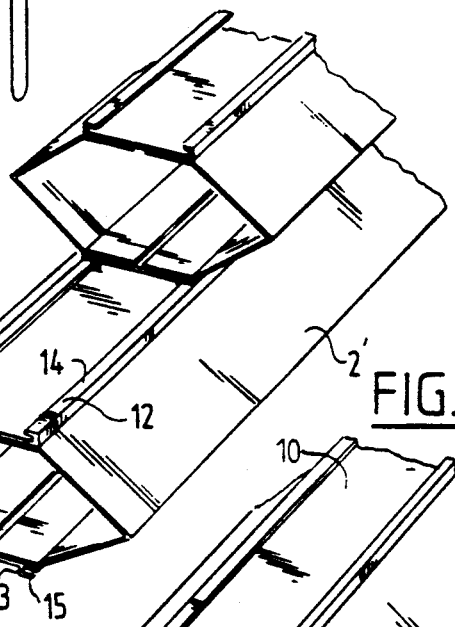
FIG. 2 is a perspective view of a portion of the modules of the curtain according to FIG. 1 in a first embodiment.

The invention is based on the assumption that the front and the rear wall 2 and 3 contain a large number of pleats whereof in each case one or more can be mutually connected by connecting strips 10 and 11 respectively. In FIG. 2 can be seen that in each case one pleat 2, is connected to the single pleat 3' by means of the connecting strips 10, 11.

According to a further characteristic of the invention the connecting strips 10 and 11 are each embodied with a coupling means 12 and 13 respectively. The coupling means 12 is an edge flange of L-shaped cross section, wherein the flanges 14 point towards one another.

The coupling means 13 is a rib likewise of L-shaped cross section, wherein the flange 15 points outward. The configuration and the position of the coupling means 12 and 13 are such that the flanges 14, 15 hook into one another, which is shown at the top in FIG. 2. The connection can be realised by sliding the strips 10 in lengthwise direction along the strips 11. It will be apparent that in this manner the height of the curtain can be determined at random by coupling to each other the required number of strips 10 and 11.

The curtain is therefore constructed of a module at a time consisting of a fold 2', a fold 3', a connecting strip 10 and a connecting strip 11. It will likewise be apparent that the design pattern of the modules can be made at random so that a curtain 1 assembled from modules can also have any desired pattern.

It is further of advantage that the connecting strips 10, 11 can display a determined stiffness which is partly caused by the L-shaped coupling flanges 12, 13, whereby relatively broad curtains can be made without this involving any noticeable sagging.

It is finally noted that the material of the pleat 2', 3' can be different from that of the connecting strips 10, 11, wherein the connection between both material types can be effected by glueing or the like, see FIG. 2.

Figure 3:
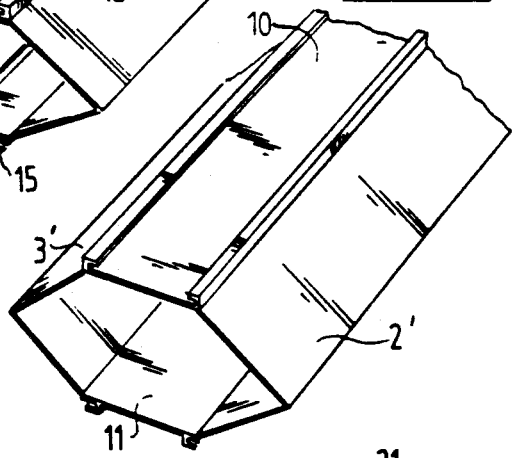
FIG. 3 is a perspective view corresponding with FIG. 2 of a portion of the module for a double-walled folding curtain according to the invention, which is shown as extruded profile.

According to another embodiment as in FIG. 3 it is possible to extrude the connecting strips 10, 11 together with the folds 2', 3' of the pleat as a tubular or box-like material. A separate connecting operation between the pleat strips and the connecting strips is thereby avoided. The assembly of a curtain from modules as according to FIG. 3 is the same as described with reference to FIG. 2.

Figure 4:
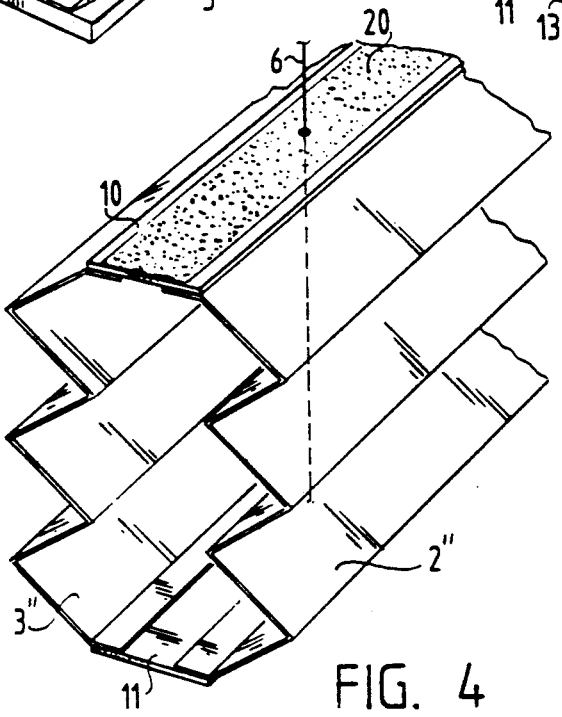
FIG. 4 shows a perspective view corresponding with FIG. 2 of a portion of the module according to a third embodiment.

FIG. 4 shows an embodiment wherein not just one fold but three folds of the pleat 2" and the pleat 3" are mutually connected by connecting strips 10, 11. The assembly of curtains of great height can be hereby simplified as a result of the modules of greater height. The connection of the strips 10, 11 can take place in random manner, for example as according to the embodiment in FIG. 2, but also for instance by means of adhesive strips 20 situated on the outward facing sides of the connecting strips 10, 11.

Figure 5:
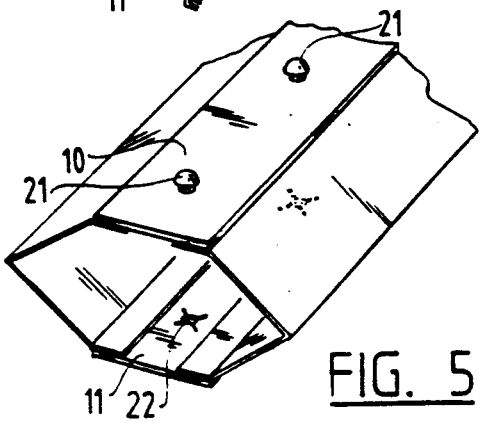
FIG. 5 shows a perspective view corresponding with FIG. 2 of a portion of the module according to a fourth embodiment.

FIG. 5 shows an embodiment wherein a snap coupling is possible between the strips 10, 11. The strip 10 is embodied to this end with standing bosses 21 which display a thickened head. The strip 11 on the other hand is embodied with through-holes 22 which lie in line with the bosses 21. By making star-shaped incisions into the material around the holes 22 a determined flexibility is obtained whereby the thickened head of boss 21 can be carried through the hole 22. With this manner of connection it is not necessary to carry out a sliding movement between the connecting strips 10, 11 to be connected to each other, all that is required is to snap the strips onto each other and subsequently thread through the operating cords 6. Substitution of the modules can be carried out in all cases in a simple manner after the connecting cord 6 has first been removed, following which it can finally be arranged once again with one or more new modules therein.

The invention is not limited to the above described embodiment.

I claim:

1. In a double-walled curtain of pleated material, the improvement comprising:

a series of separate and distinct modules having integral means for connecting adjacent modules, said connecting means being located on a top and a bottom of each of said modules, said modules being interconnectable along a respective length of each module with adjacent modules being arranged in said series so as to provide a curtain panel; and each said module comprising pleated walls, which are oppositely disposed along said length so as to define a longitudinal space between said walls, and said connecting means separably and reconnectably interconnecting said modules of said series, thereby presenting a continous pleated appearance of said curtain panel.

2. The improvement as in claim 1, wherein said connecting means comprises:

male and female members which, when interconnected, present a substantially planar surface-to-surface interface between modules.

3. The improvement as in claim 2, wherein said connecting means comprises:

bosses protruding from a planar top surface of each module, said bosses being insertable into corresponding holes in a planar bottom surface of an adjacent module so as to form a releasable snap connection in addition to said surface-to-surface interface between said modules.

4. The improvement as in claim 1, wherein said connecting means comprises:

at least one adhesive strip.

5. The improvement as in claim 1, and further comprising:

said modules being structurally similar so as to be interchangeable with each other, whereby modules may be added to and removed from said curtain in order to vary the size of the curtain or to allow replacement of a damaged or defective module from anywhere in a series of said interconnected modules.

6. The improvement as in claim 1, and further comprising:

said module consisting of an extruded material.

* * * * *